US008051528B2

(12) United States Patent
Davis et al.

(10) Patent No.: US 8,051,528 B2
(45) Date of Patent: Nov. 8, 2011

(54) METHOD OF MAINTAINING A BOWLING LANE

(75) Inventors: Mark E. Davis, Sebring, FL (US); John M. Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 1135 days.

(21) Appl. No.: 11/424,027

(22) Filed: Jun. 14, 2006

(65) Prior Publication Data

US 2007/0289086 A1 Dec. 20, 2007

(51) Int. Cl.
*A47L 11/10* (2006.01)

(52) U.S. Cl. ..... 15/320; 15/319

(58) Field of Classification Search ..... 15/340.3
See application file for complete search history.

(56) References Cited

U.S. PATENT DOCUMENTS 2,763,019 A * 9/1956 Huber ..... 118/103
3,042,950 A * 7/1962 Ludwig, Jr. et al. ..... 15/50.3
3,083,390 A * 4/1963 Wroten ..... 15/103.5
3,099,851 A * 8/1963 Unterbrink ..... 15/50.3
3,105,987 A * 10/1963 Riedi ..... 15/98
3,116,504 A * 1/1964 Unterbrink et al. ..... 15/231
3,150,395 A * 9/1964 Lucky ..... 15/98
3,150,396 A * 9/1964 Unterbrink ..... 15/98
3,150,407 A * 9/1964 Mitchell ..... 401/21
3,216,036 A * 11/1965 Rockwood et al. ..... 15/98
3,216,037 A * 11/1965 Stevens et al. ..... 15/98
3,217,347 A * 11/1965 Domecki ..... 15/51
3,319,600 A * 5/1967 Regan ..... 118/108
3,321,331 A * 5/1967 McNeely ..... 401/22
3,340,559 A * 9/1967 Klose ..... 15/210.1
3,418,672 A * 12/1968 Regan ..... 15/98
3,604,037 A * 9/1971 Varner ..... 15/4
3,729,769 A * 5/1973 Sharpless ..... 15/347
3,785,001 A * 1/1974 Niemi et al. ..... 15/245
3,787,916 A * 1/1974 Akagi et al. ..... 15/4
3,868,738 A * 3/1975 Horst et al. ..... 15/4
4,134,361 A * 1/1979 Benjamin ..... 118/73
4,246,674 A * 1/1981 Ingermann et al. ..... 15/4
4,463,469 A * 8/1984 Green ..... 15/98
4,510,642 A * 4/1985 Ingermann et al. ..... 15/231
D281,362 S * 11/1985 Ingermann et al. ..... D32/50
4,562,610 A * 1/1986 Davis et al. ..... 15/228
4,727,615 A * 3/1988 Kubo ..... 15/98
4,738,000 A * 4/1988 Kubo ..... 15/98
4,856,138 A * 8/1989 Ingermann et al. ..... 15/320
4,920,604 A * 5/1990 Ingermann et al. ..... 15/302
4,937,911 A * 7/1990 Picchietti et al. ..... 15/320
4,959,884 A * 10/1990 Ingermann et al. ..... 15/302
4,962,565 A * 10/1990 Ingermann et al. ..... 15/302
4,980,815 A 12/1990 Davis
5,063,633 A * 11/1991 Ingermann et al. ..... 15/320
5,133,280 A * 7/1992 Kubo ..... 118/259
5,161,277 A * 11/1992 Ingermann et al. ..... 15/98
5,181,290 A * 1/1993 Davis et al. ..... 15/98
5,185,901 A * 2/1993 Davis et al. ..... 15/98
5,194,077 A * 3/1993 Bargiel et al. ..... 55/300

(Continued)

*Primary Examiner* — Lee D Wilson
*Assistant Examiner* — Jamal Daniel
(74) *Attorney, Agent, or Firm* — Hovey Williams LLP

(57) ABSTRACT

A bowling lane maintenance machine has its operating functions designed and controlled in such a manner that the machine may be battery-operated without loss of performance. Included in the operation are special movements of the machine at the pin deck to flick moisture off blades of the squeegee assembly and limited activation of the vacuum motor to reduce battery drain.

9 Claims, 13 Drawing Sheets

U.S. PATENT DOCUMENTS 5,243,728 A * 9/1993 Smith et al. ..... 15/98
5,274,871 A * 1/1994 Smith et al. ..... 15/98
5,455,977 A * 10/1995 Caffrey et al. ..... 15/98
5,517,709 A * 5/1996 Caffrey et al. ..... 15/98
5,629,049 A * 5/1997 Caffrey et al. ..... 427/429
5,641,538 A * 6/1997 Caffrey et al. ..... 427/8
5,650,012 A * 7/1997 Davis ..... 118/681
5,679,162 A * 10/1997 Caffrey et al. ..... 118/684
5,729,855 A * 3/1998 Davis ..... 15/50.3
5,753,043 A * 5/1998 Davis ..... 118/681
5,761,762 A * 6/1998 Kubo ..... 15/320
5,935,333 A * 8/1999 Davis ..... 118/681
6,023,813 A * 2/2000 Thatcher et al. ..... 15/320
6,090,203 A * 7/2000 Gebhardt et al. ..... 118/305
6,383,290 B1 * 5/2002 Davis et al. ..... 118/207
6,615,434 B1 * 9/2003 Davis et al. ..... 15/98
6,685,778 B2 * 2/2004 Davis et al. ..... 118/684
6,790,282 B2 * 9/2004 Davis et al. ..... 118/663
6,923,863 B1 * 8/2005 Baker et al. ..... 118/207
6,939,404 B1 * 9/2005 Davis et al. ..... 118/207
7,014,714 B2 * 3/2006 Buckley et al. ..... 118/323
7,056,384 B2 * 6/2006 Davis et al. ..... 118/207
7,060,137 B2 * 6/2006 Davis et al. ..... 134/21
D530,463 S * 10/2006 Ambasz et al. ..... D32/16
D531,766 S * 11/2006 Ambasz et al. ..... D32/15
7,531,041 B2 * 5/2009 Davis ..... 118/268
7,578,020 B2 * 8/2009 Jaworski et al. ..... 15/50.3
7,611,583 B2 * 11/2009 Buckley et al. ..... 118/323
7,784,139 B2 * 8/2010 Sawalski et al. ..... 15/50.3
7,784,147 B2 * 8/2010 Burkholder et al. ..... 15/320
2003/0140848 A1 * 7/2003 Davis et al. ..... 118/207
2004/0010873 A1 * 1/2004 Davis et al. ..... 15/98
2005/0081782 A1 * 4/2005 Buckley et al. ..... 118/207
2005/0196544 A1 * 9/2005 Davis et al. ..... 427/429
2005/0229340 A1 * 10/2005 Sawalski et al. ..... 15/50.3
2005/0255248 A1 * 11/2005 Baker et al. ..... 427/356
2006/0107894 A1 * 5/2006 Buckley et al. ..... 118/207
2006/0130754 A1 * 6/2006 Sias et al. ..... 118/695
2006/0278161 A1 * 12/2006 Burkholder et al. ..... 118/323
2006/0288519 A1 * 12/2006 Jaworski et al. ..... 15/340.1
2007/0012247 A1 * 1/2007 Davis ..... 118/260
2007/0289086 A1 * 12/2007 Davis et al. ..... 15/340.3
2008/0109983 A1 * 5/2008 Davis ..... 15/319
2009/0019652 A1 * 1/2009 Goldberg et al. ..... 15/49.1
2010/0006028 A1 * 1/2010 Buckley et al. ..... 118/696
2011/0162156 A1 * 7/2011 Burkholder et al. ..... 15/97.1
2011/0183065 A1 * 7/2011 Schlegel et al. ..... 427/9

* cited by examiner

METHOD OF MAINTAINING A BOWLING LANE

TECHNICAL FIELD

The present invention relates to the field of bowling lane maintenance machines, in particular, to machines that can both clean and dress the lanes as they move along the surface thereof. It relates especially to a machine whose various operating functions are carried out in such a manner as to render the machine suitable for, but not necessarily limited to, battery operation so as to eliminate the need for an electrical supply cord connecting the machine to a source of electrical house current.

BACKGROUND AND SUMMARY

It is well known in the prior art to provide a lane machine that applies cleaning liquid to the lane at the front of the machine, picks up the liquid, surface grime and old dressing (oil) near the middle of the machine, and then applies a new film of oil to the cleaned surface at the rear of the machine as the machine is traveling along the length of the lane. In the past, such machines have required connection to house current through a long, unwieldy supply cord because the sequence of operations performed by the machine drew too much electrical current to make battery operation practical considering the significant number of lanes in a bowling facility.

In a machine constructed in accordance with the principles of the present invention the operational steps of the machine are such that battery operation can become a practical reality, without sacrificing quality and speed. Although the inventive operating steps are beneficial even if not incorporated into a machine that is battery-powered, the convenience of battery operation makes incorporating these principles into a battery-powered machine particularly attractive.

DETAILED DESCRIPTION

Figure 1:
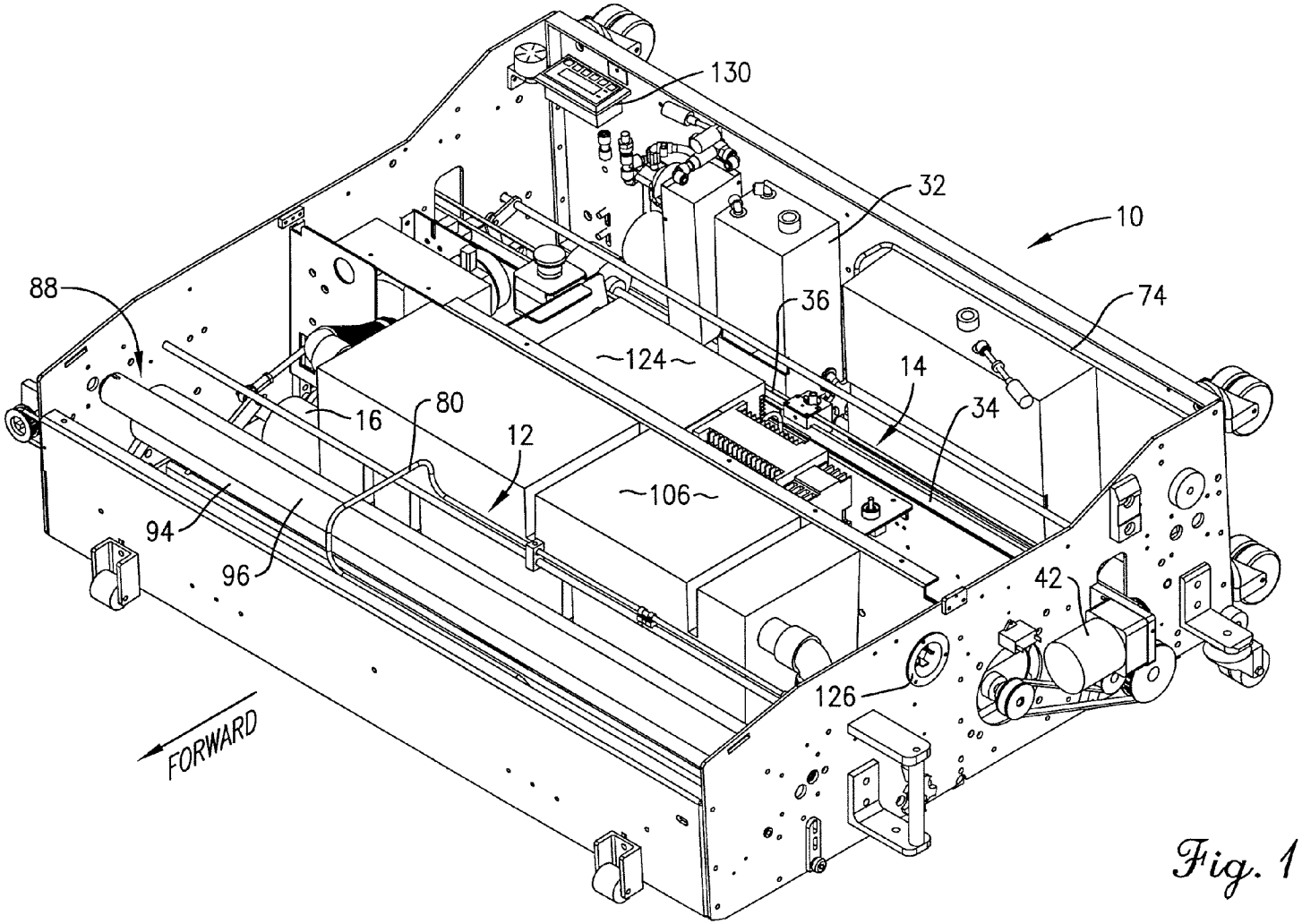
FIG. 1 is a left front perspective view of a maintenance machine embodying the principles of the present invention with its top cover removed to reveal internal details of construction.
Figure 2:
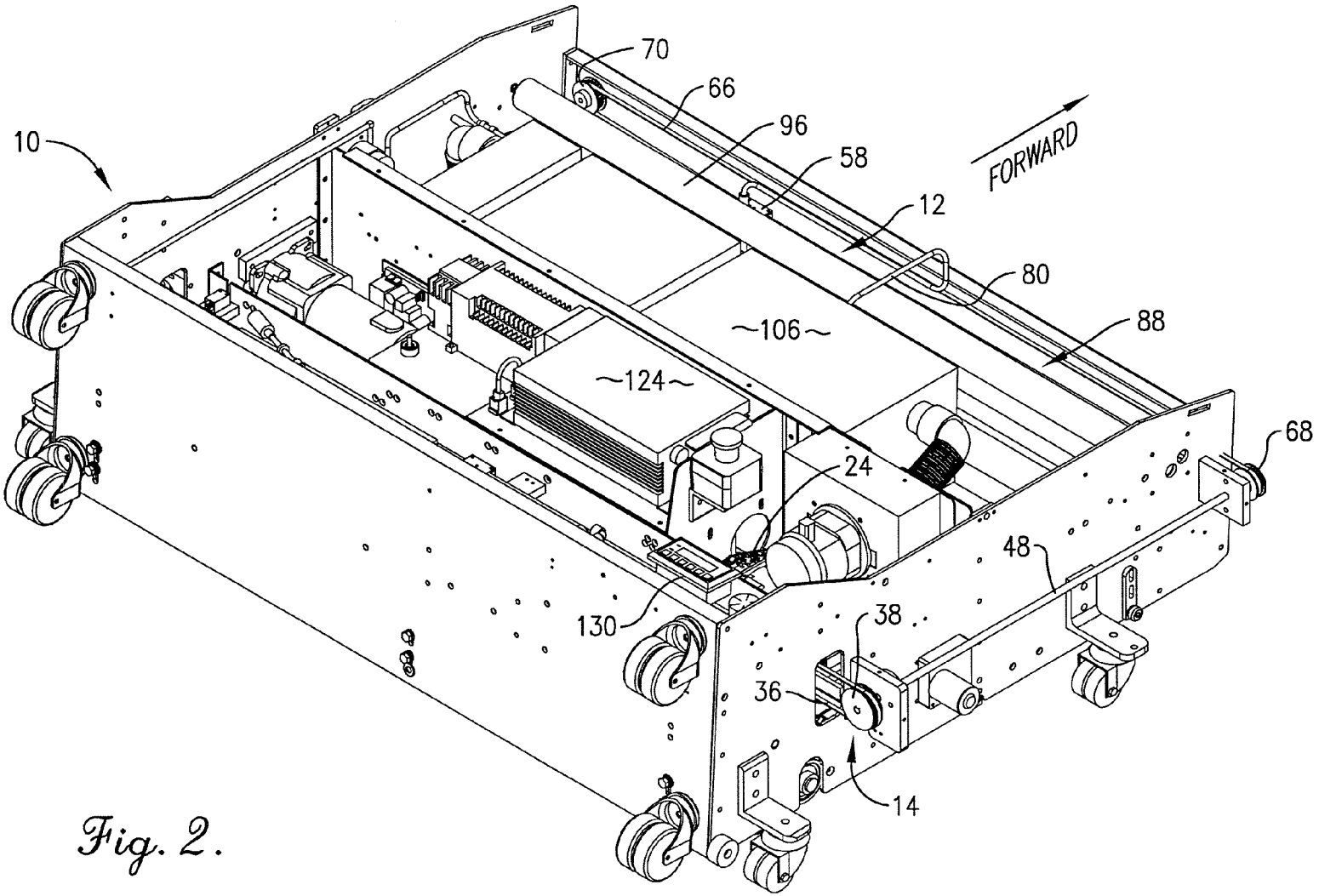
FIG. 2 is a right rear perspective view of the machine.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

The machine 10 illustrated in the drawings is similar in many respects to the machine disclosed in U.S. Pat. No. 5,729,855 and U.S. Pat. No. 6,939,404. Accordingly, the '855 and '404 patents are hereby incorporated by reference into the present specification. In view of the full disclosure in the '855 and '404 patents of the construction and operation of the lane machine, the construction and operation of the machine 10 will be described only generally herein.

Figure 9:
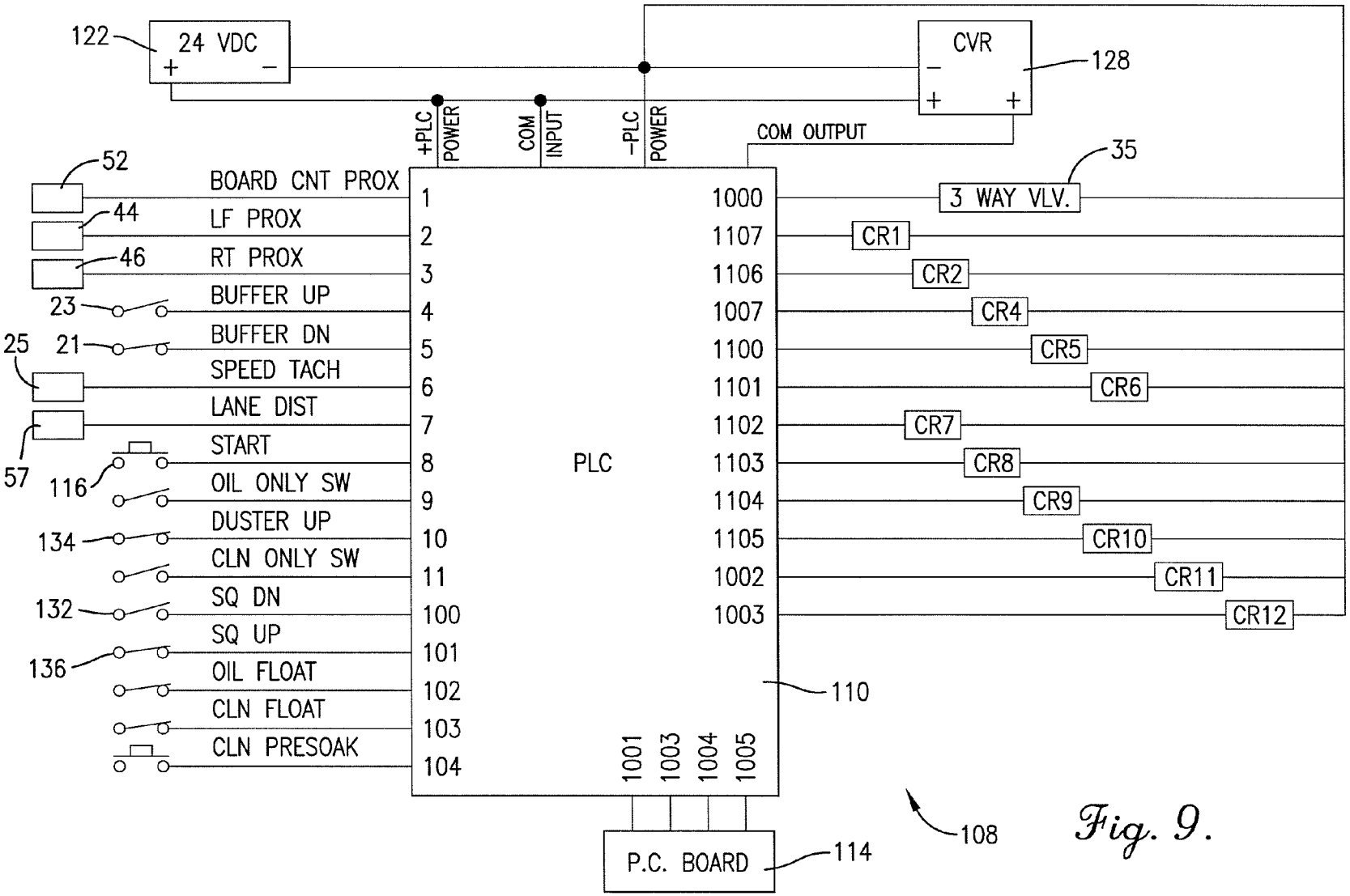
FIGS. 9-13 are block diagrams of the different portions of the electrical system of the machine.

The machine 10 has a cleaning system denoted broadly by the numeral 12 and located generally in the front of the machine. A dressing (preferably oil) application system is denoted broadly by the numeral 14 and located generally in the rear portion of the machine. These two systems perform their functions as the machine is propelled down the lane and back by lane-engaging drive wheels 16 and 18 fixed to a transverse shaft 20 that is powered by a drive motor 22 (Baldor 24VDC model 24A531Z019G1) and a chain and sprocket assembly 24. A conventional proximity sensor speed tachometer 25 (FIG. 9) is coupled with the end of drive shaft 20.

Figure 10:
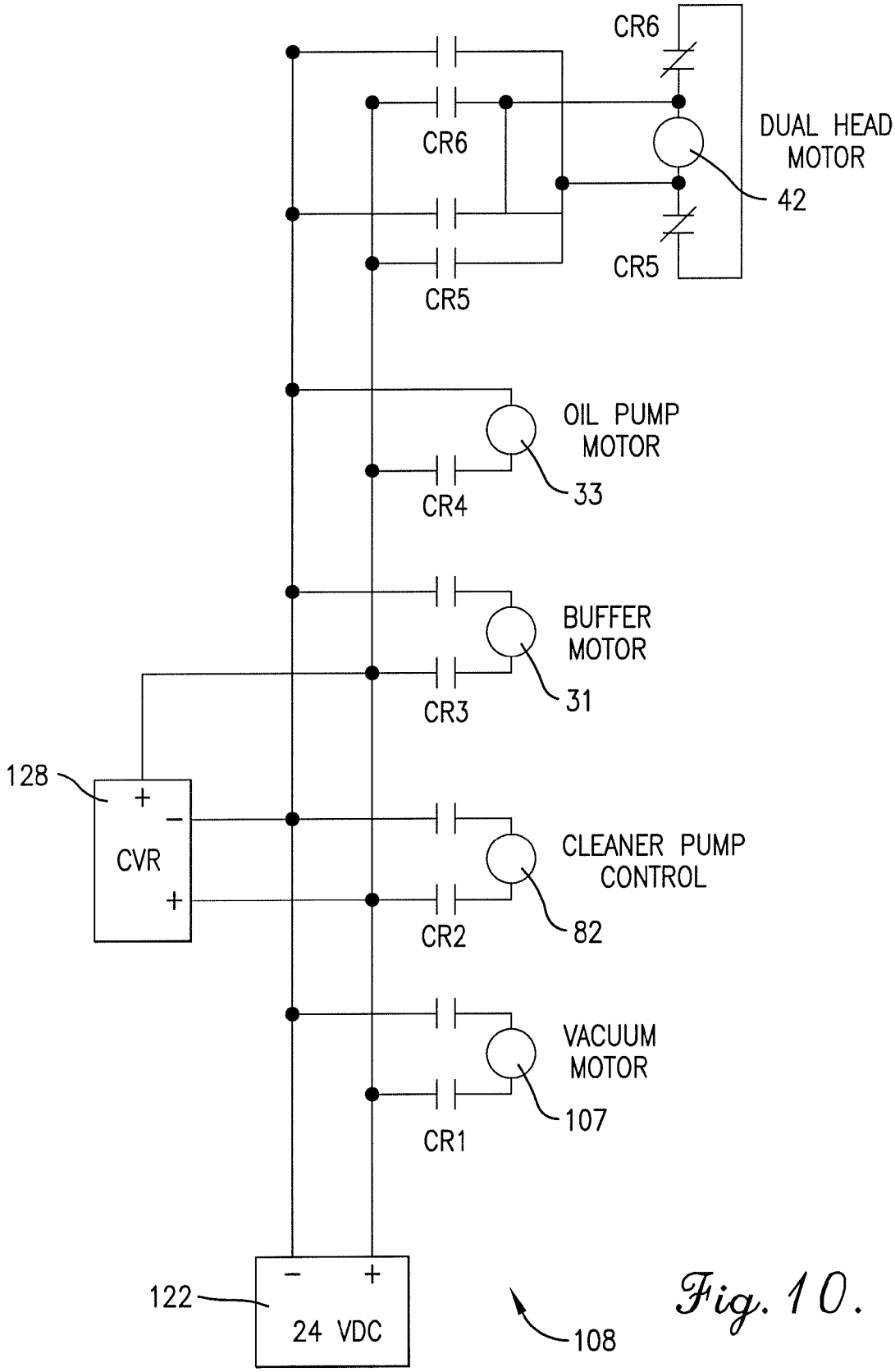
Figure 12:
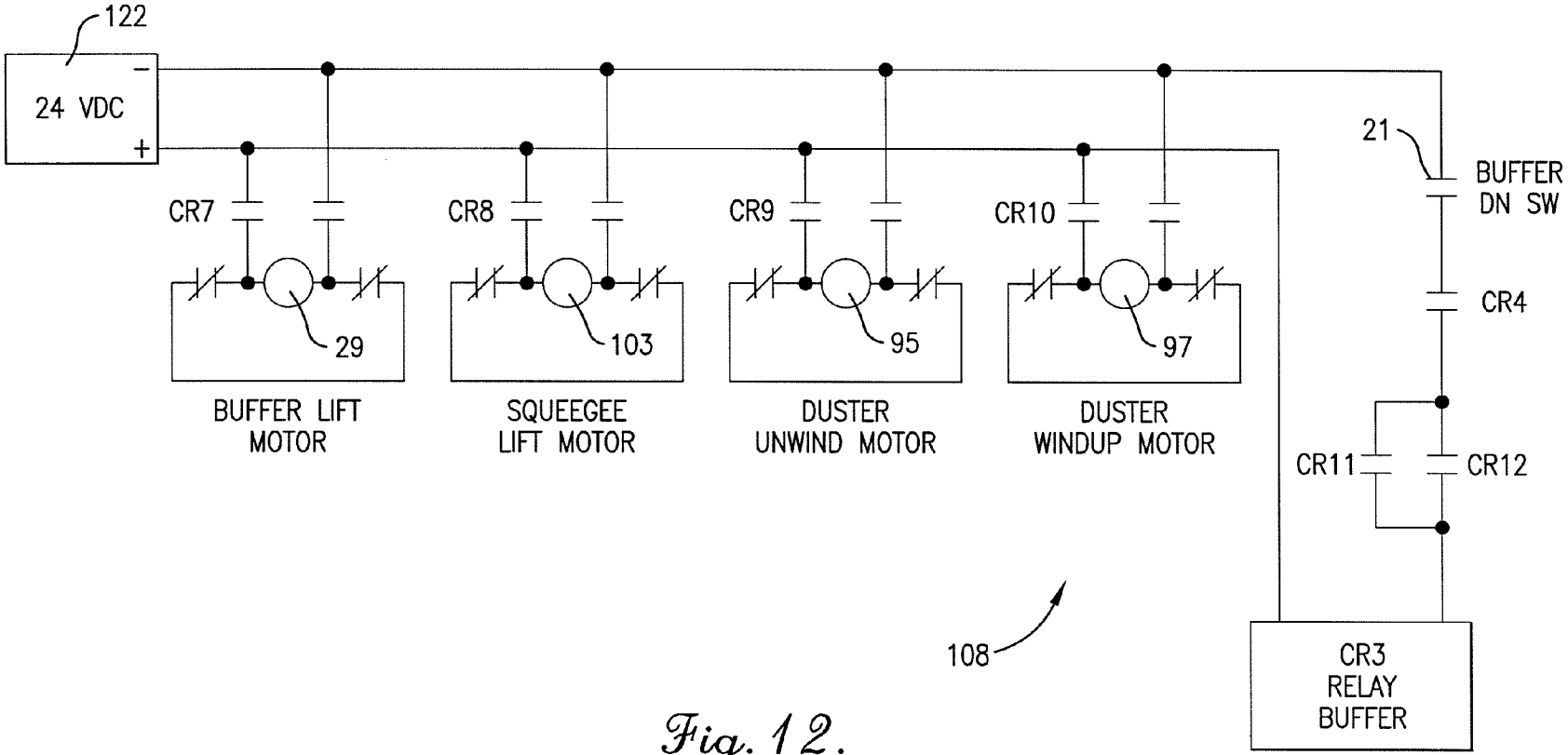

The oil application system 14 includes an applicator roll 26 (hereinafter sometimes referred to as the "buffer") disposed for engaging the lane surface, a reciprocating oil dispensing head 28 that travels back and forth across the width of the lane above buffer 26, and a brush assembly 30 between buffer 26 and dispensing head 28 for receiving oil from head 28 and delivering it to buffer 26. Buffer 26 is rotatably driven by a buffer motor 31 (Baldor 24 VDC model 24A532Z046G1) (FIG. 10). Buffer 26 pivots up and down, in and out of contact with the bowling lane surface by way of linkage 27 operated by a buffer up/down motor 29 (Merkle Korff 31 RPM 24VDC model S-3727-87D) (FIG. 12). In the down position, buffer 26 operates a buffer down limit switch 21 and operates a buffer up limit switch 23 in the up position.

Details of the construction and manner of use of brush assembly 30 are disclosed in U.S. Pat. No. 7,056,384 titled "Strip Brush Bowling Lane Dressing Application Mechanism", which is hereby incorporated by reference herein. Oil application system 14 additionally includes a reservoir 32, a positive displacement pump (not shown) (FMI model RHOCKC Lab Pump Jr.) having a motor 33 (FIG. 10) (Dayton 24 VDC model3XE19) for supplying oil from reservoir 32 to dispensing head 28, and a three-way valve 35 (FIG. 9) for controlling the flow of oil. In a recycle position valve 35 recycles oil back to reservoir 32, and in a delivery position valve 35 delivers oil from pump 33 to dispensing head 28.

Oil dispensing head 28 is mounted for reciprocation along a transverse guide track 34 extending between the sidewalls of the machine. An endless drive belt 36 is secured to head 28 and has its opposite ends looped around a pair of pulleys 38 and 40, the pulley 40 being operably coupled with a reversible motor 42 (Crouzet 24 VDC model 808050Y07.66Z) to provide driving power to belt 36 and thus propel dispensing head 28 along track 34. A pair of left and right sensors in the form of proximity switches 44 and 46 adjacent opposite ends of the path of reciprocal travel of dispensing head 28 are operable to sense the presence of dispensing head 28 as it reaches the limits of its path of travel so as to signal the motor 42 to reverse directions and drive dispensing head 28 in the opposite direction along track 34.

The pulley 38 is fixed to a long fore-and-aft extending shaft 48 disposed just outboard of the right sidewall of the machine. Near its rear end, just forwardly of pulley 38, shaft 48 is provided with a notched wheel 50 whose rotation is sensed by a sensor 52. An output from sensor 52 is sent to the control system of the machine (described in more detail below) for the purpose of determining the precise location of the oil dispensing head 28 across the width of the machine and the bowling lane. Such location is coordinated with a particular lane oil pattern that has been programmed into the control system of the machine so that oil dispensing head 28 may be actuated to precisely dispense oil at predetermined locations along its path of reciprocation.

Figure 3:
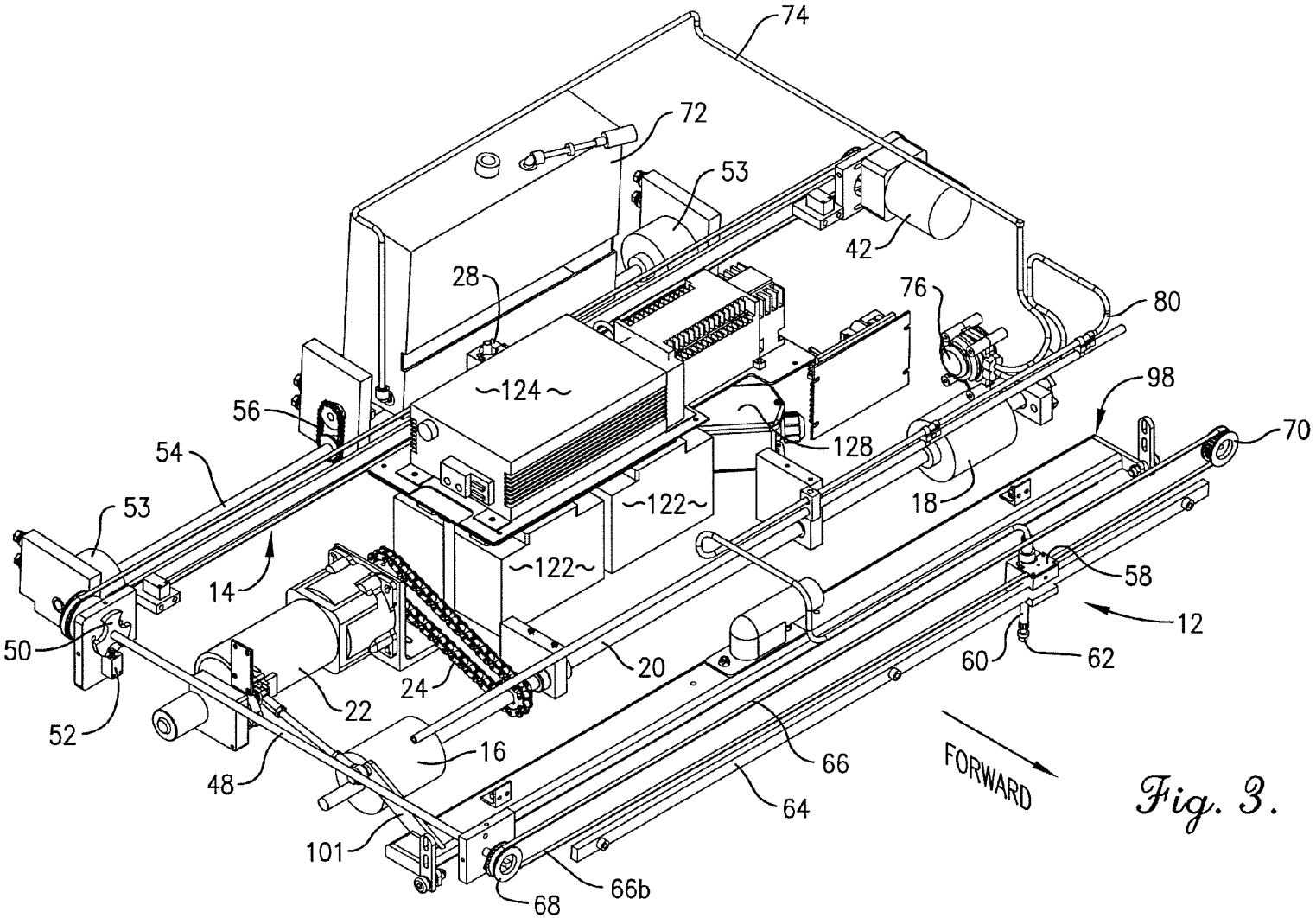
FIG. 3 is a right front perspective illustration of certain internal components of the machine with walls and other structures removed for clarity.
Figure 4:
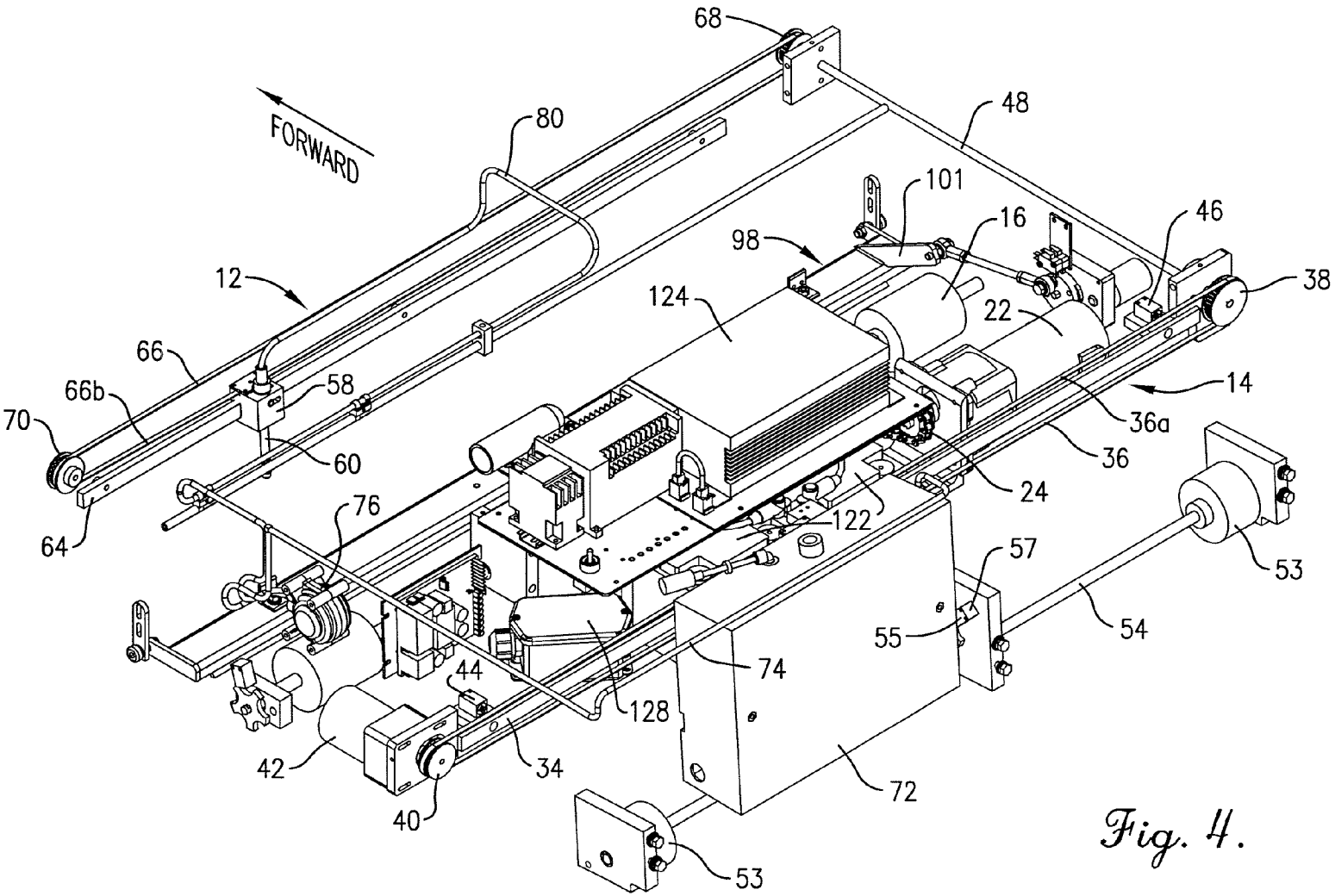
FIG. 4 is a left rear perspective illustration of certain internal components of the machine with walls and other structures removed for clarity.

Distance down the lane is determined by a pair of lane-engaging wheels 53 (FIGS. 3, 4 and 5) located just in front of the rear wall of the machine. Wheels 53 are fixed to a common cross shaft 54 that rotates a notched wheel 55 (FIG. 4) via a chain drive 56 (FIG. 3). The number of revolutions of notched wheel 55 is detected by a sensor 57 (FIG. 4) that sends a signal to the control system of the machine.

The cleaning system 12 includes one or more cleaning liquid dispensing heads 58 that reciprocate across the path of travel of the machine as it moves along the lane. While system 12 may also include one or more pressurized spray nozzles as in conventional machines, in a preferred embodiment no such conventional spray nozzles are utilized. In the particular embodiment disclosed herein, only a single dispensing head 58 is utilized, such head 58 traveling essentially the full transverse width of the machine to the same extent as the oil dispensing head 28.

Dispensing head 58 includes a vertically disposed, depending discharge tube 60 provided with a tip 62 that is located close to the lane surface. In one form of the invention, tip 62 is not in the nature of an atomizing nozzle but is instead configured and arranged to emit liquid in a fairly coherent stream so that a bead of cleaning liquid is laid down on the lane surface. One suitable tip 62 for carrying out this particular non-atomizing function is available from the Value Plastics Company of Fort Collins, Colo. as part number VPS5401001N. Other types of tips (not shown) that atomize, breakup or diffuse liquid supplied to the tip may also be utilized where broader surface area coverage by the cleaning liquid is desired. In either case, tip 62 is preferably provided with an internal check valve (not shown).

Cleaning system 12 further includes a guide track 64 attached to the front wall of machine 10 that slidably supports dispensing head 58 for its reciprocal movement. Track 64 extends across substantially the entire width of machine 10 to the same extent as the track 34 associated with oil dispensing head 28. An endless drive belt 66 is attached to dispensing head 58 for providing reciprocal drive thereto, the belt 66 at its opposite ends being looped around a pair of pulley wheels 68 and 70 respectively.

Although pulley 68 may be driven in a number of different ways, including by its own separate drive motor, in a preferred form of the invention pulley 68 is fixed to the forward most end of shaft 48 from pulley 38 so that both dispensing heads 28 and 58 are driven by the same reversible motor 42. Consequently, both oil dispensing head 28 and cleaning liquid dispensing head 58 are reciprocated simultaneously by motor 42 when the latter is actuated. However, it will be noted that oil dispensing head 28 and cleaning liquid dispensing head 58 reciprocate in mutually opposite directions due to the fact that oil dispensing head 28 is secured to the upper run 36*a* of its drive belt 36 while cleaning liquid dispensing head 58 is secured to the lower run 66*b* of its drive belt 66.

Figure 11:
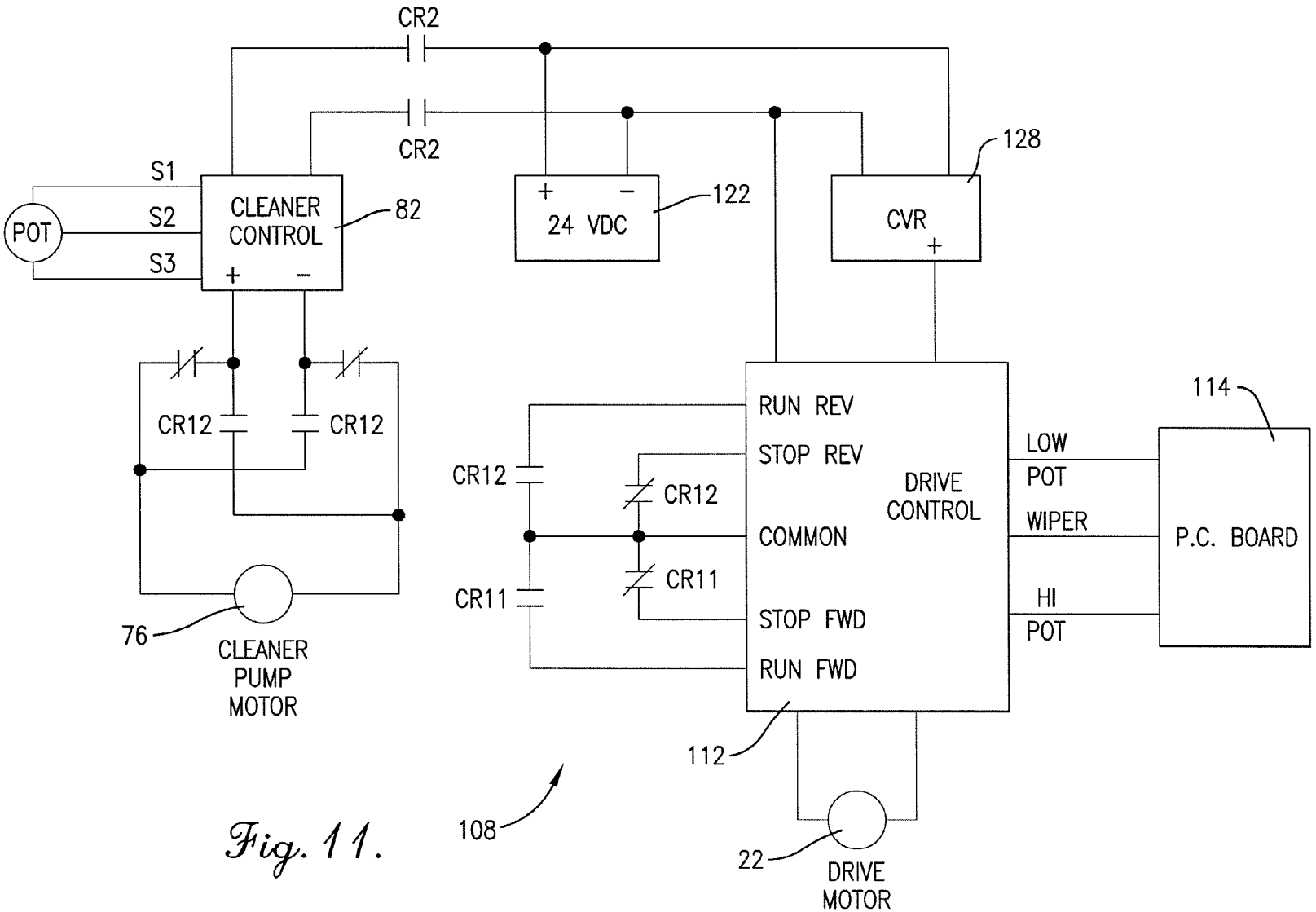

Cleaning system 12 further includes a cleaning solution reservoir 72 at the rear of machine 10. A supply line 74 leading from reservoir 72 is coupled in flow communication with a reversible peristaltic pump 76 (Barnant 24 VDC model D-3138-0009). An outlet line 80 from pump 76 leads to discharge tube 60 of dispensing head 58 for supplying cleaning liquid to head 58. A cleaner control 82 (FIGS. 10 and 11) is electrically connected to cleaner pump 76 for adjusting the speed of pump 76, and thus the amount of cleaner discharged by head 58.

Because pump 76 is preferably a peristaltic pump, it supplies liquid to dispensing head 58 in constant volume slugs or squirts that enable the cleaning liquid to be very precisely and accurately metered onto the lane surface. Furthermore, it permits the supply of liquid to dispensing head 58 to be essentially instantaneously stopped and started, which, in conjunction with the control valve, affords precise, board-by-board control over the pattern of cleaning liquid applied to the lane surface by dispensing head 58.

Cleaning system 12 additionally includes a wiping assembly 88 immediately behind cleaning liquid dispensing head 58. Assembly 88 includes a web 90 of soft material such as duster cloth looped around a lower compressible back-up member 92 in the nature of a roller that extends across the full width of the machine. Cloth 90 is stored on a roll 94 and is paid out at intervals selected by the operator and taken up by a takeup roll 96. Wiping assembly 88 is similar in principle to the corresponding wiping assembly disclosed in U.S. Pat. No. 6,615,434, which patent is hereby incorporated by reference into the present specification. A duster unwind motor 95 (FIG. 12) (Merkle Korff 9 RPM 24VDC S-3828-87D) is coupled with roll 94 and, when activated, rotates roll 94 to let out slack in the cloth, allowing backup member 92 to gravity to the lane surface. A duster windup motor 97 (FIG. 12) (Merkle Korff 9 RPM 24VDC S-3828-87D) is coupled with takeup roll 96 and, when activated, rotates roll 96 to raise backup member 92 off the lane surface.

Figure 5:
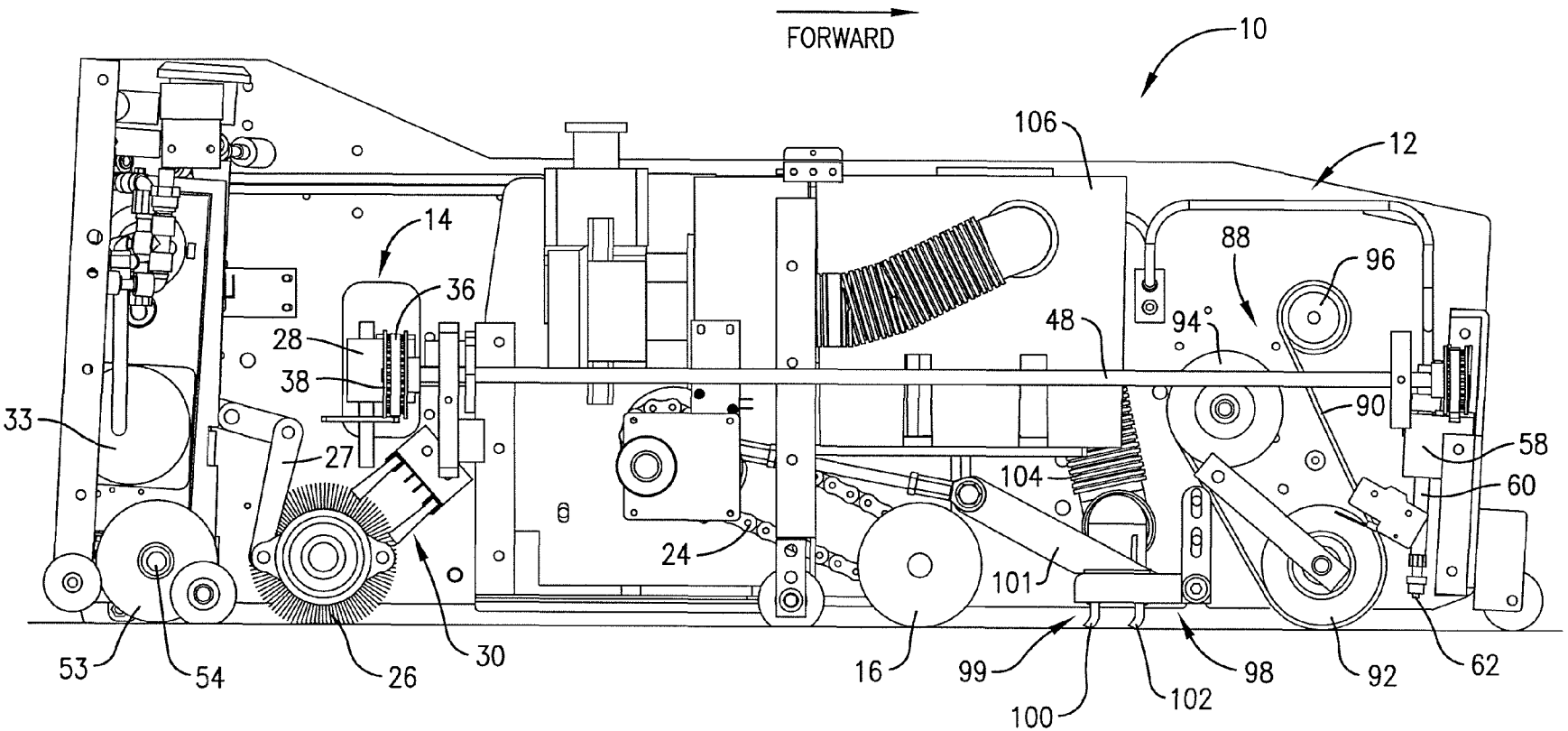
FIG. 5 is a right side elevational view of the machine with the near sidewall thereof removed to reveal internal details of construction.
Figure 6:
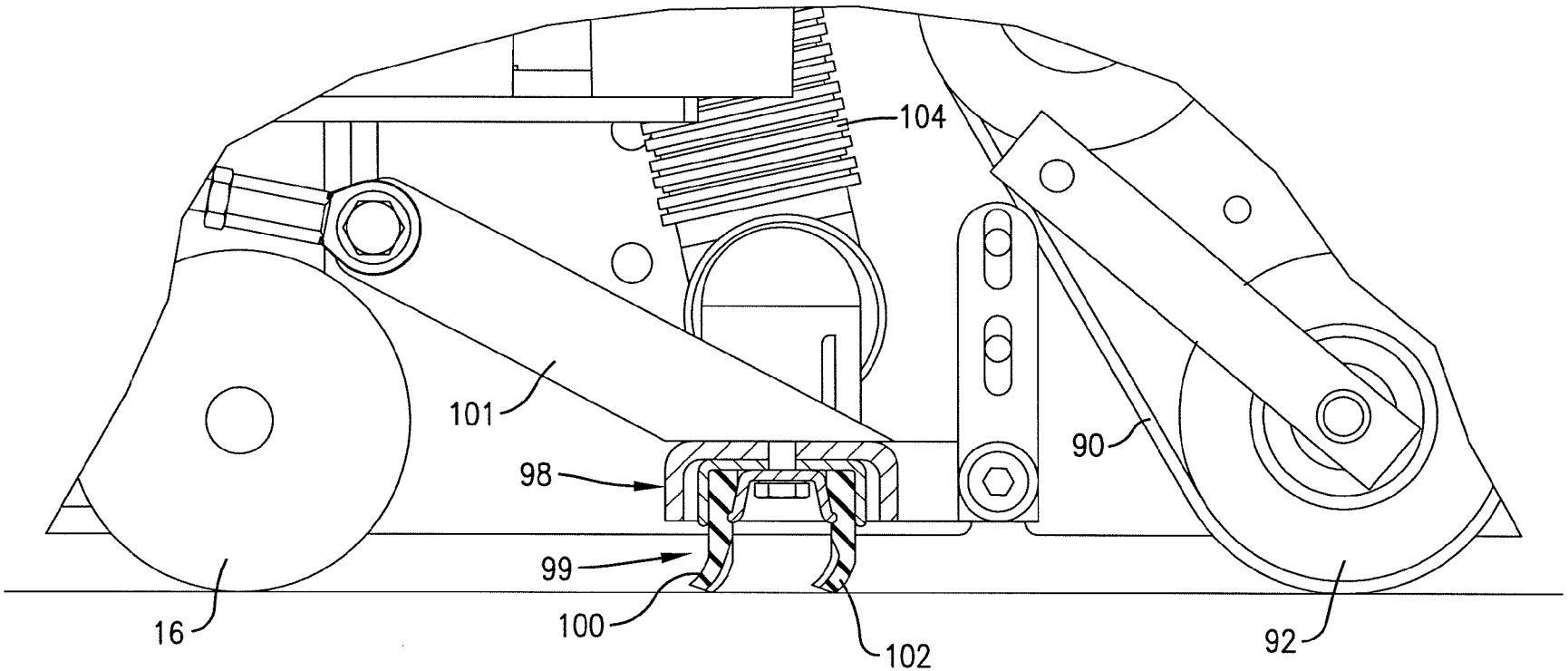
FIG. 6 is an enlarged, fragmentary right side elevational view of the machine illustrating the action of the squeegee blades as they engage the lane during forward travel of the machine.
Figure 7:
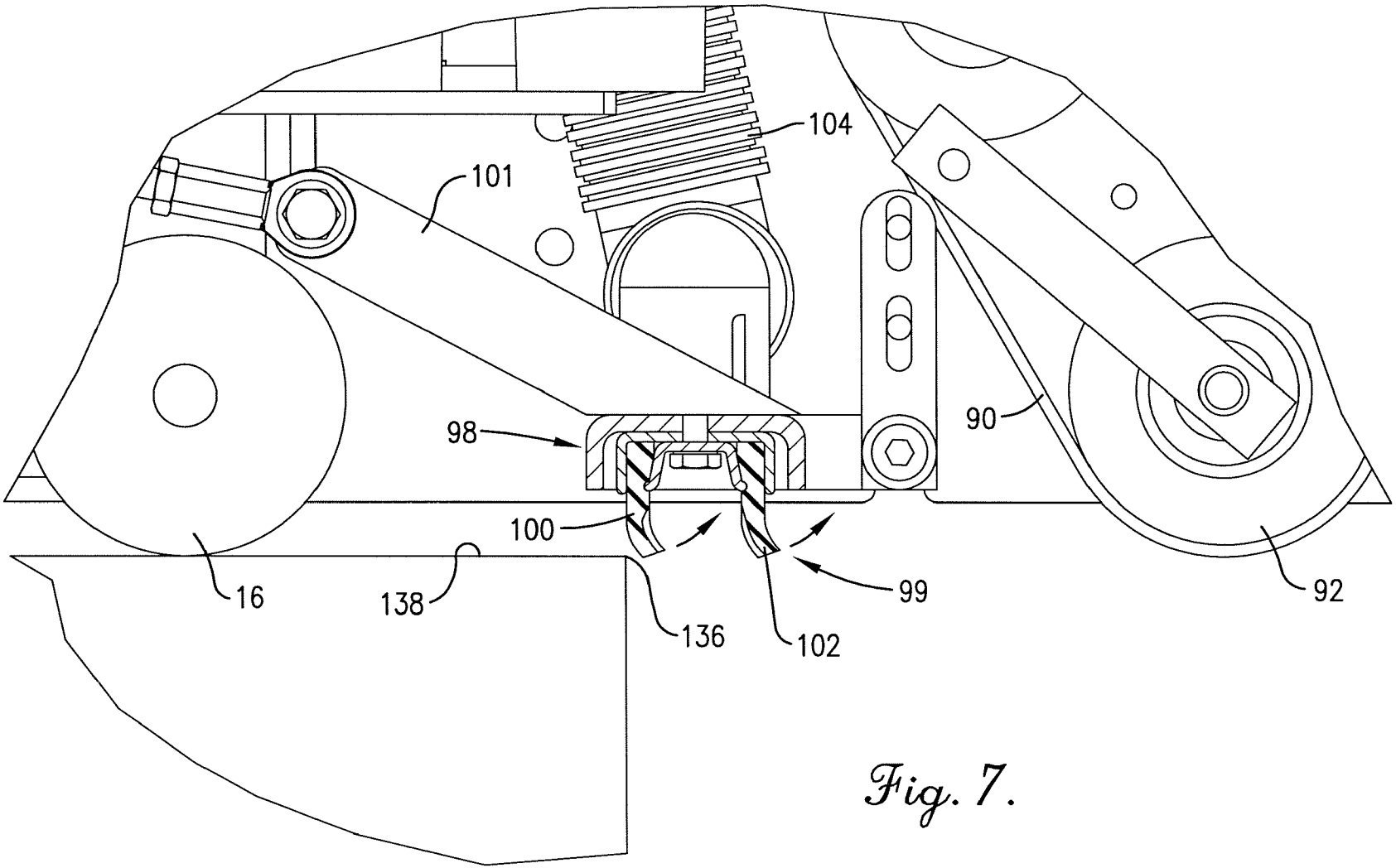
FIG. 7 is an enlarged, fragmentary right side elevational view of the machine similar to FIG. 6 but illustrating the machine stopped at the end of its forward travel with the squeegee assembly passed beyond and overhanging the edge of the pin deck to flip moisture off the squeegee assembly.
Figure 8:
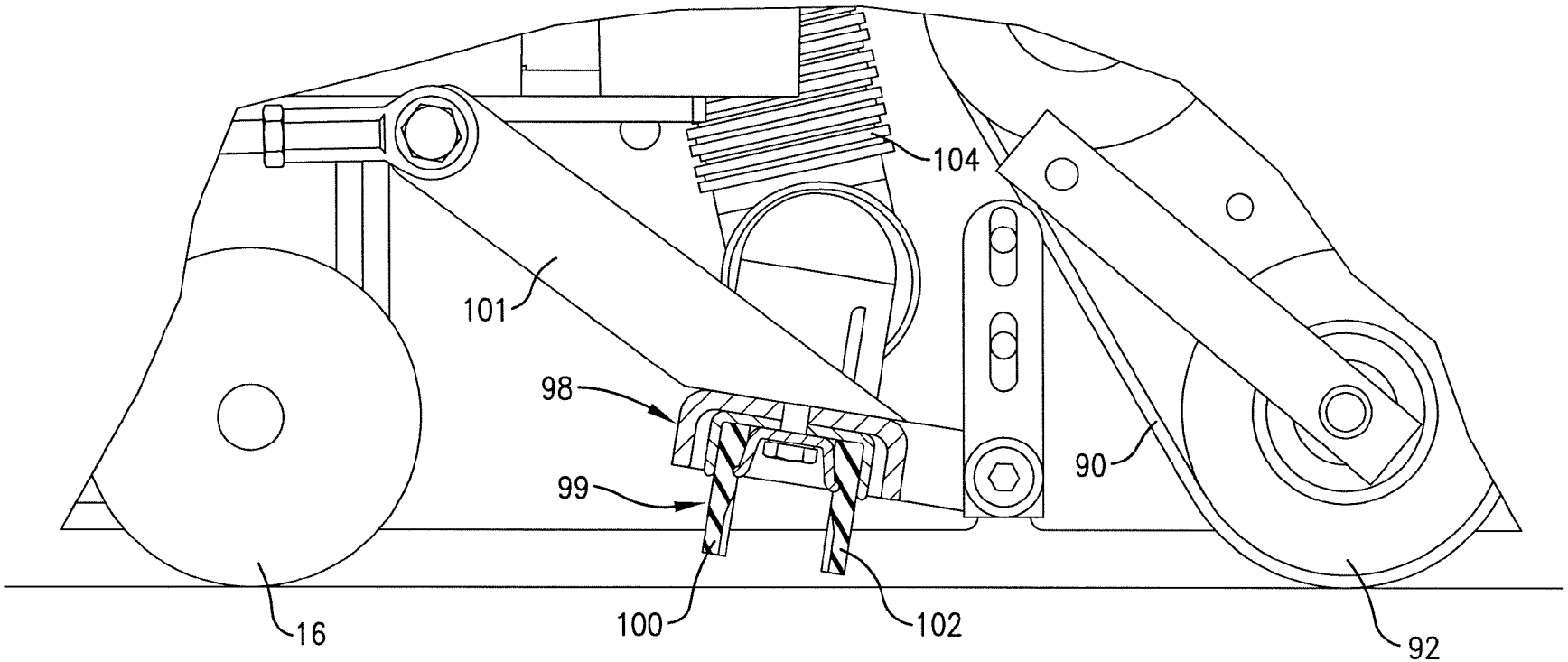
FIG. 8 is an enlarged, fragmentary right side elevational view of the machine similar to FIG. 6 but illustrating the squeegee assembly in a raised position.

A further component of cleaning system 12 comprises a vacuum pickup head 98 located behind wiping assembly 88. Vacuum pickup head 98 extends essentially the full width of machine 10 and includes a squeegee assembly 99 comprising a pair of resilient, squeegee-type blades 100 and 102 that assist in picking up the thin film of cleaning liquid left on the lane surface after the wiping assembly 88 has acted upon the liquid. Lift linkage 101 is connected to a squeegee lift motor 103 (FIG. 12) (Merkle Korff 31 RPM 24 VDC S-3727-87D) and is operably coupled with suction head 98 and squeegee assembly 99 for moving the same between an operating position in engagement with the lane as shown in FIGS. 5,6 and 7 and a raised position out of engagement with the lane as shown in FIG. 8. A large vacuum hose 104 leads from pickup head 98 to a holding tank 106 for storing liquid picked up by head 98. Vacuum pressure within holding tank 106 is obtained by means of a vacuum motor 107 (Ametek 24 VDC model 116155-00) (FIG. 10) coupled with tank 106.

FIGS. 9-12 are block diagrams illustrating various portions of the control system 108 of machine 10. Control system 108 includes, in addition to the electrical components already mentioned above, controller 110 (programmable logic controller Omron model CPM2A), drive motor control 112, printed circuit board 114, and control relays CR1, CR2, CR3, CR4, CR5, CR6, CR7, CR8, CR9, CR10, CR11, and CR12. Control system 108 further includes start switch 116 (FIG. 9) and an emergency stop switch 117 (FIG. 13).

Figure 13:
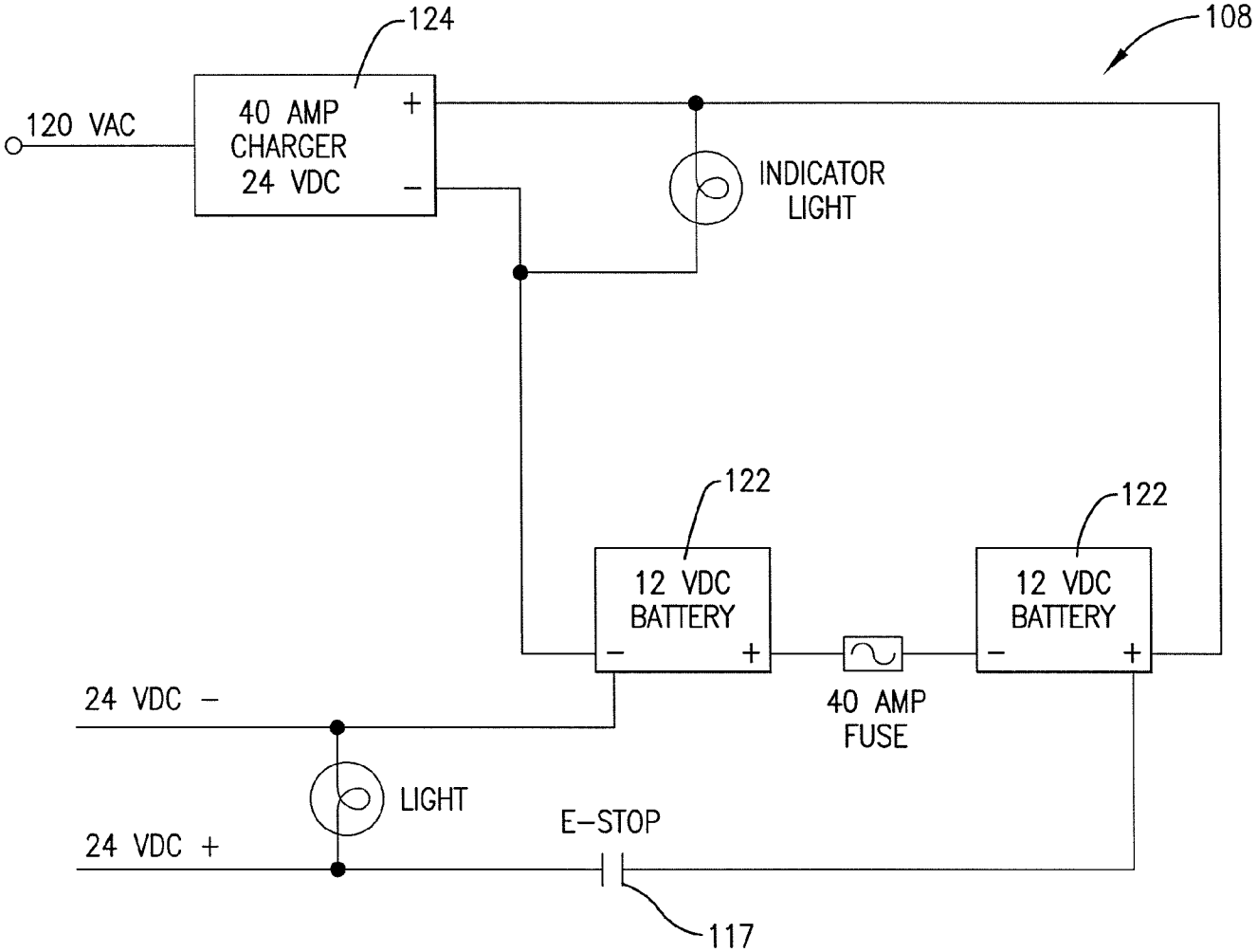

An electrical power supply system 120 for machine 10 is illustrated in FIG. 13, portions of system 120 also being visible in FIGS. 1-12. In a preferred embodiment of the invention, the heart of power system 120 comprises a pair of series-connected, 12 VDC rechargeable storage batteries 122 (EnerSys Energy Products model Odyessey PC925) that jointly provide up to 24 volts DC power to operating components of the machine. Batteries 122 are connected to a forty amp charger 124 (Iota charger model DLS-27-40 with IQ Smart Charge Controller) that, in turn, is connected to a receptacle 126 (FIG. 1) on the left sidewall of the machine. Receptacle 126 may be connected to a 120 VAC outlet in the bowling center using an electrical supply cord (not shown) in order to recharge batteries 122 from time-to-time, or to run the machine on 120 VAC power supply. As is well understood by those skilled in the art, charger 124 converts 120 VAC power from the supply cord to 24 VDC power for recharging batteries 122 and/or for operating the 24 VDC operating and control components of the machine. Preferably, a constant voltage regulator 128 (Solar Converters Inc. model CVP 12/24-15) is interposed between batteries 122 on the one hand and dispensing head motor 42, oil pump motor 33, buffer motor 31, three-way valve 35, and drive motor 22 on the other hand to maintain constant voltage to such components.

Operation

The operation of machine 10 is controlled by way of the programmed operating controller 110. Although machine 10 may be selectively operated through appropriate switches to clean the lanes only, or to oil the lanes only, in the following example machine 10 is operated to both clean and oil the lanes.

Initially machine 10 is placed on the approach of a bowling lane just behind the foul line. The operator presses start switch 116 one time, which initiates the sequence of maintenance operations. A variety of lane oil patterns can be selected byway of the key pad and display 130 (FIG. 1) as is conventional. The duster unwind motor 95 comes on at this time to dispense a new section of cloth, but if the normally open contacts of duster up switch 134 do not open up, there will be a "duster empty" error displayed. The squeegee assembly 99 will move down and stop when the normally open contacts of down switch 132 close. If the switch contacts do not close, there will be a "squeegee did not lower" error displayed. The oil pump 33 also turns on.

The machine 10 is then pushed onto the lane and properly seated. The start switch 116 is pressed a second time and the dispensing heads motor 42 will start up and cause both heads 28 and 58 to begin moving. Oil dispensing head 28 moves from left to right, as the lane is viewed from the foul line looking toward the pin deck, while cleaner head 58 moves from right to left.

Cleaner pump motor 76 is energized at the same time as heads motor 42. Thus, as cleaner head 58 starts to move, it also starts to apply cleaner instantly to the lane and does not stop until the last programmed "squirt distance" down the lane has been reached. When the oil head 28 reaches the right board edge proximity switch 46, the moving heads 28, 58 will reverse their directions and oil head 28 will begin to apply the first stream of oil.

The oiling head 28 is now moving in a right-to-left direction, while cleaner head 58 is moving in a left-to-right direction. When oiling head 28 reaches the left board edge proximity switch 44, the heads motor 42 will reverse, at which time buffer motor 31 starts up and drive motor 22 is energized to start the machine moving down the lane. Vacuum motor 107 has remained in an "off" condition during this initial startup phase, but after machine 10 has traveled about two feet down the lane, vacuum motor 107 turns on. It is also to be noted that after start switch 116 has been pressed a second time, machine 10 will start a clock (not shown) to record the total amount of run time on the display 130. The total amount of time the three-way valve 35 dispenses oil for each lane is also shown in the display 130.

As machine 10 travels forward down the lane, the oiling and cleaning heads 28, 58 continue to operate, applying oil and cleaner. The board-counting sensor 52 monitors the positions of the moving heads 28, 58. If the motion is interrupted, an error message will be displayed.

During movement of the machine 10 down the lane, the lane distance sensor 57 counts inches traveled and monitors movement of the machine. If travel is interrupted, an error message will be displayed. The speed of machine 10 is also being monitored by the speed tack 25 and is displayed continuously. As the machine continues to move forward, speeds will change (through a drive motor speed control (KB model KBBC-24)) and oil and cleaner will continue to be dispensed to the lane as programmed. As the machine approaches the applied oil distance in accordance with the selected program, the oil pump motor 33 turns off but the buffer motor 31 stays on so buffer 26 continues to buff oil onto the lane.

When the oil distance is reached, buffer 26 stops and buffer lift motor 29 is energized to raise buffer 26 off the lane until buffer up limit switch 23 is operated. If the contacts for raising buffer 26 do not close, there will be an error message displayed. If the up switch 23 sticks closed when it should be open, a "brush down" error message will be displayed.

Additionally, when the oil distance has been reached machine 10 will shift into high speed and continue to travel toward the pin deck. As the machine approaches the pin deck, the programmed distance for the application of cleaner will be reached, causing cleaner pump motor 76 to be turned off and heads motor 42 to be deenergized so as to stop movement of dispensing heads 28, 58. At the same time the machine will down-shift to low speed to reduce its momentum into the pin deck.

When machine 10 enters the pin deck, the duster windup motor 97 will turn on and start to windup the cloth to raise the backup member 92. The normally open contacts of the duster up switch 134 will close to turn off the duster windup motor 97. If the contacts do not close, there will be a "duster did not wind up" error message displayed.

Machine 10 then continues the rest of its travel with squeegee assembly 99 engaging the lane in the manner illustrated in FIG. 6 before coming to a stop at a point where the front of the machine, including squeegee assembly 99, travels off and overhangs the edge 136 of the pin deck 138 as illustrated in FIG. 7. Drive motor 50 has been shut off. This allows the resilient blades 100, 102 of squeegee assembly 99, which have been flexed rearwardly as the machine travels forwardly down the lane, to flip resiliently forwardly in a quick snapping action and throw off cleaning liquid moisture that may otherwise cling to the blades. Squeegee lift motor 103 is then activated to lift squeegee assembly 99 and suction head 98 into a raised position as illustrated in FIG. 8. Squeegee lift motor 103 stops when the normally open contacts of the squeegee up limit switch 136 close. If the contacts do not close, an error message will be displayed.

Drive motor 50 is then driven in reverse for a short duration, causing machine 10 to move in the reverse direction toward the foul line and stop after moving four inches. The squeegee assembly 99 and suction head 98 are then lowered to re-engage the blades 100, 102 with the pin deck 138. Drive motor 50 is then driven in forward to advance the machine forwardly four inches, whereupon it stops to once again cause squeegee assembly 99 to overhang the edge 136 of pin deck 138. Blades 100, 102 snap forwardly to flip off any excess moisture. The squeegee assembly 99 then lifts.

Drive motor 50 now reverses to cause machine 10 to move in the reverse direction toward the foul line at high speed. At the same time vacuum motor 107 is turned off and cleaner pump motor 76 is run in reverse for one second to help reduce the possibility of dripping cleaner out of tip 62 of the cleaner head 58.

As machine 10 travels in reverse, the lane distance sensor 57 counts inches traveled and continuously monitors movement of the machine. If travel is interrupted, an error message will be displayed. As the machine reaches the oil distance, buffer 26 begins to lower and stops in its down position when the normally open contacts of the buffer down switch 21 close. If the contacts do not close, an error message is displayed. If the down switch 21 sticks closed when it should be open, a "brush up" error message will be displayed.

Buffer motor 31 is then energized, causing buffer 26 to begin buffing as the machine continues its travel in reverse. The oil head 28 starts dispensing oil again when the machine reaches the first "reverse load" distance on the lane according to the selected oil pattern program. The machine progressively down-shifts to lower speeds as it continues toward the foul line. When the last reverse load of oil has been applied, the oil head 28 stops and parks. Once the machine reaches the foul line, drive motor 50 is deactivated, causing the machine to stop and await operator attention to move it to the approach of the next lane.

If at any time during its travel up and down the lane machine 10 stops and displays a "LOW BATTERY OR E-STOP PRESSED" warning, this means either battery voltage has dropped below seventeen volts or the emergency stop switch 117 (FIG. 13) has been pressed. In either case, the machine will need to be returned to the foul line and connected to the 120 VAC house power supply for recharging or running on house current using the electrical power supply cord.

The constant voltage regulator 128 plays a significant role in the machine 10 if it is battery-powered (there is no requirement that the machine functions as above described be incorporated into battery-powered machines. However, significant ease-of-use benefits are achieved when they are.) Because the constant voltage regulator 128 is capable of maintaining a constant voltage of twenty-four volts to the key functions of the machine even though the batteries may run down to twenty or twenty-one volts, there is no gradual loss of performance. The machine shows no signs of losing battery power until the voltage drops so low (such as seventeen volts) that the controller 110 simply shuts down and the machine stops and displays the warning. The dispensing head motor 42, oil pump motor 33, buffer motor 31, three-way valve 35, and drive motor 22 all operate from the constant voltage regulator 128.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

The invention claimed is:

1. In a method of maintaining a bowling lane using a maintenance machine, the steps of:

applying a liquid cleaner to the lane as the machine travels in a forward direction from the foul line toward the pin deck;

drawing liquid cleaner off the lane using a vacuum motor during at least a portion of the travel of the machine in the forward direction from the foul line to the pin deck;

maintaining the vacuum motor turned off during at least most of the travel of the machine in a reverse direction from the pin deck to the foul line;

using a squeegee assembly in engagement with the lane to help remove cleaning liquid from the lane as the machine travels in the forward direction;

stopping movement of the machine in the forward direction when the squeegee assembly passes beyond and overhangs the edge of the pin deck, the method further comprising moving the squeegee assembly to a raised position after the machine has stopped in its position overhanging the edge of the pin deck of the lane, then maintaining the squeegee assembly raised as the machine moves in the reverse direction for a predetermined distance, then moving the squeegee assembly to a lowered position in engagement with the lane, then maintaining the squeegee lowered as the machine moves in the forward direction, and then stopping the machine when the squeegee assembly passes beyond and overhangs the edge of the pin deck of the lane for a second time.

2. In a method of maintaining a bowling lane as claimed in claim 1, further comprising supplying electrical operating power to the machine from an electrical storage battery on board the machine.

3. In a method of maintaining a bowling lane machine as claimed in claim 1, further comprising maintaining said vacuum motor turned off when the machine is at the foul line before commencing travel in the forward direction, said vacuum motor being turned on only after the machine has traveled a predetermined distance in the forward direction.

4. In a method of maintaining a bowling lane as claimed in claim 1, further comprising moving the squeegee assembly to its raised position after the machine overhangs the edge of the pin deck of the lane for a second time and maintaining the squeegee assembly raised and the vacuum motor turned off for at least most of the travel of the machine to the foul line in the reverse direction.

5. In a method of maintaining a bowling lane as claimed in claim 4, further comprising maintaining said vacuum motor turned off when the machine is at the foul line before commencing travel in the forward direction, said vacuum motor being turned on only after the machine has traveled a predetermined distance in the forward direction.

6. In a method of maintaining a bowling lane using a maintenance machine, the steps of:

applying a liquid cleaner to the lane as the machine travels in a forward direction from the foul line toward the pin deck;

using a squeegee assembly in engagement with the lane to help remove cleaning liquid from the lane as the machine travels in the forward direction; and stopping movement of the machine in the forward direction when the squeegee assembly passes beyond and overhangs the edge of the pin deck, further comprising moving the squeegee assembly to a raised position after the machine has stopped in its position overhanging the edge of the pin deck of the lane, then maintaining the squeegee assembly raised as the machine moves in the reverse direction for a predetermined distance, then moving the squeegee assembly to a lowered position in engagement with the lane, then maintaining the squeegee lowered as the machine moves in the forward direction, and then stopping the machine when the squeegee assembly passes beyond and overhangs the edge of the pin deck of the lane for a second time.

7. In a method of maintaining a bowling lane as claimed in claim 6, further comprising moving the squeegee assembly to its raised position after the machine overhangs the edge of the pin deck of the lane for a second time and maintaining the squeegee assembly raised and the vacuum motor turned off for at least most of the travel of the machine to the foul line in the reverse direction.

8. In a method of maintaining a bowling lane a claimed in claim 6, further comprising drawing liquid cleaner off the lane using a vacuum motor during at least a portion of the travel of the machine in the forward direction from the foul line to the pin deck; and maintaining the vacuum motor turned off during at least most of the travel of the machine in a reverse direction from the pin deck to the foul line.

9. In a method of maintaining a bowling lane as claimed in claim 6, further comprising supplying electrical operating power to the machine from an electrical storage battery on board the machine.

* * * * *